United States Patent [19]

Moist, Jr.

[11] 4,169,648

[45] Oct. 2, 1979

[54] STRAIN RELIEF AND BACK COVER FOR ELECTRICAL CONNECTOR

[75] Inventor: Stanford C. Moist, Jr., Hummelstown, Pa.

[73] Assignee: AMP Incorporated, Harrisburg, Pa.

[21] Appl. No.: 911,643

[22] Filed: Jun. 1, 1978

[51] Int. Cl.[2] ..... H01R 13/58

[52] U.S. Cl. ..... 339/103 R; 339/164 R; 339/206 P

[58] Field of Search ..... 339/103, 107, 163, 164 R, 339/165, 206 R, 206 P, 208

[56] References Cited

U.S. PATENT DOCUMENTS

| | | | |
|---|---|---|---|
| 3,170,749 | 2/1965 | Johanson et al. | 339/107 |
| 3,535,674 | 10/1970 | Hansen | 339/107 |
| 3,858,960 | 1/1975 | Kunkle et al. | 339/206 R |
| 3,879,099 | 4/1975 | Shaffer | 339/107 X |
| 4,005,922 | 2/1977 | Burkhart et al. | 339/107 X |
| 4,108,527 | 8/1978 | Douty et al. | 339/107 |

*Primary Examiner*—Roy Lake

*Assistant Examiner*—DeWalden W. Jones

*Attorney, Agent, or Firm*—Frederick W. Raring

[57] ABSTRACT

A hermaphroditic back cover and strain relief part for an electrical connector is disclosed. The part is intended to be mounted on an electrical connector along with an identical part to form a back cover and strain relief. The back cover part comprises a rearward end and first, second, and third co-extensive sidewalls, the first and second sidewalls being parallel to each other and the third sidewall extending normally of the other sidewalls. An inclined shoulder is provided on the external surface of the first sidewall. Means are provided for securing the part to a connector housing and for securing the part to an identical part in opposed relationship thereto. In use, the two parts are mounted on the rearward end of the connector housing with the conductors extending beyond the rearward ends of the parts. The internal surface of each second sidewall is positioned over the recessed surface adjacent to the shoulder of each first sidewall to form an enclosure around the connector.

10 Claims, 6 Drawing Figures

6
16
2
22
52
44
32
66'
22'
60'
64'
16
62'
8
68'
34'
72'
16
4
10

66
24
22
26
28
62
6
2
30
34
50
56
36
52
58
42
54
40
20
32
8
44
38
72'
46
48
68'
16
18
14
12
10
4
32'
44'
22'
58'
56'
36'
70'
26'
28'
34'
30'
24'
62'

STRAIN RELIEF AND BACK COVER FOR ELECTRICAL CONNECTOR

DESCRIPTION

BAKGROUND OF THE INVENTION

Multi-contact electrical connectors of the type which comprise housings, a plurality of contact terminals in the housing, and conductors extending from the terminals and from the rearward face of the housing are commonly provided with back covers for the housing and strain relief devices which clamp the conductors adjacent to the rearward face of the housing. The back covers serve the purpose of protecting the connector against physical damage while the strain relief ensures that tensile forces applied to the conductors will not be transmitted to the terminals but will be diverted to the insulating housing of the connector. A wide variety of multi-contact connectors are used in the electrical industry and a similarly wide variety of strain relief devices and back covers are used for the connectors.

The instant invention is directed to improved combined back cover and strain relief device which consists of two identical back cover parts. The parts are each adapted to be mounted on the rearward portions of the connector housing and secured to each other in a manner such that the two back cover parts totally surround the rearward face of the connector. The conductors extend through the enclosure and are clamped between the opposed portions of the rearward ends of the two parts. A connector back cover and strain relief device in accordance with the invention presents several advantages for assembly. Wires of widely varying diameters can be accommodated with two parts of the same size and assembly of the back cover parts to the housing is an extremely simple operation which can be accomplished by means of a few simple manipulative steps in a minimum of time.

It is accordingly an object of the invention to provide an improved back cover and strain relief device for a multi-contact electrical connector. A further object is to provide a hermaphroditic part which can be used in conjunction with an identical part to form a back cover and strain relief for a connector. A further object is to provide a molded back cover part which can be produced at a relatively low cost and which can be used in conjunction with an identical part. A further object is to provide a strain relief device which is capable of forming a strain relief for wires of widely varying diameters.

These and other objects of the invention are achieved in a preferred embodiment thereof which is briefly described in the foregoing abstract, which is described in detail below, and which is shown in the accompanying drawing in which:

FIG. 3 is a side view of one of the back cover parts.

Figure 1:
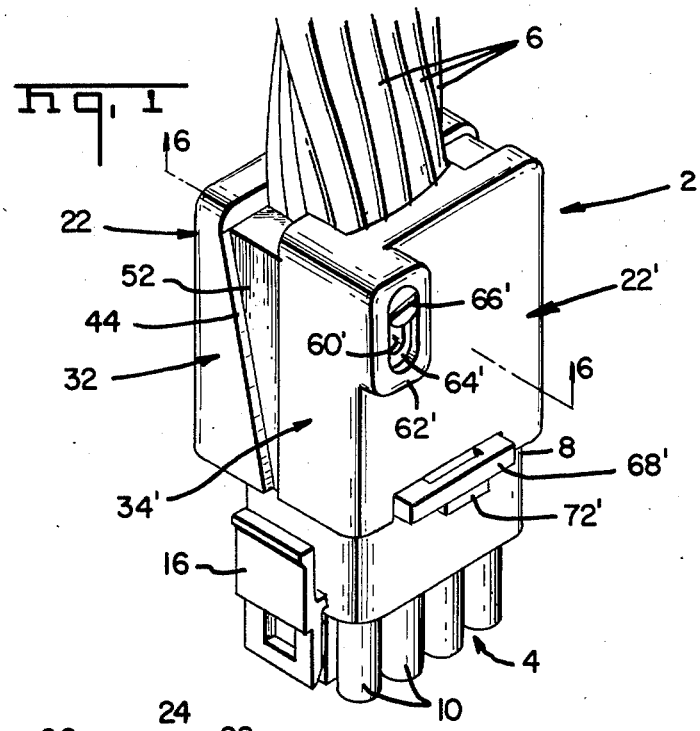
FIG. 1 is a perspective view of a back cover and strain relief assembly in accordance with the invention mounted on a multi-contact electrical connector.

FIG. 1 shows a back cover assembly 2 in accordance with the invention on the rearward end 8 of a connector 4 with conductors 6 extending from the connector being clamped by the strain relief portions of the back cover. The connector housing has tubular projections 10 extending from its forward end and cavities 20 extending therethrough from its rearward end 8 and into these projections. It will be understood that each cavity contains a contact terminal (not shown) and that the wires 6 are secured to, and extend from, these terminals. The housing has flat sidewalls 12, 14 adjacent to its rearward end 8 and latch arms 16 are provided on the sidewalls 12 so that the housing can be disengageably latched to a complementary connector when it is mated with the complementary connector. The latching arms are connected to the housing by flexible integral sections 18, the arrangement being such that the latch arms can be flexed for mating and disengagement purposes.

The back cover assembly 2 is comprised of two identical hermaphroditic parts 22 which are assembled to the housing and to each other in a manner which will be described below. The same reference numerals, differentiated by prime marks are used to identify corresponding structural features of the two housings or parts 22, 22' shown in the drawing, but specific reference is made only to the part 22 in the description which follows.

The part 22 is produced by molding a suitable thermoplastic material, such as a nylon composition, and comprises a rearward end 24 and first, second, and third sidewalls extending from the rearward end to the forward end 38. The first and second sidewalls 32, 34 are parallel to each other while the third sidewall 36 extends normally of the first and second sidewalls. The outer free edges 40, 42 of the first and second sidewalls are at the same distance from the third sidewall.

An inclined shoulder 44 extends from the forward end 48 of the part 22 to the rearward end along the external surface of the first sidewall 32. The forward end 46 of this shoulder is located adjacent to, but is spaced from, the outer end 48 of the edge 40 of the sidewall 32 and the rearward end 50 of the shoulder is adjacent to the rearward end 24 of the part 22. The external surface of the first sidewall 32 thus comprises a recessed portion 52 which extends from the edge 40 to the shoulder 44 and a raised or elevated section 54 which extends from the shoulder to the edge of the third sidewall. This shoulder permits the part 22 and the identical part 22' to accommodate wires of widely varying diameters as will be explained below.

Figure 2:
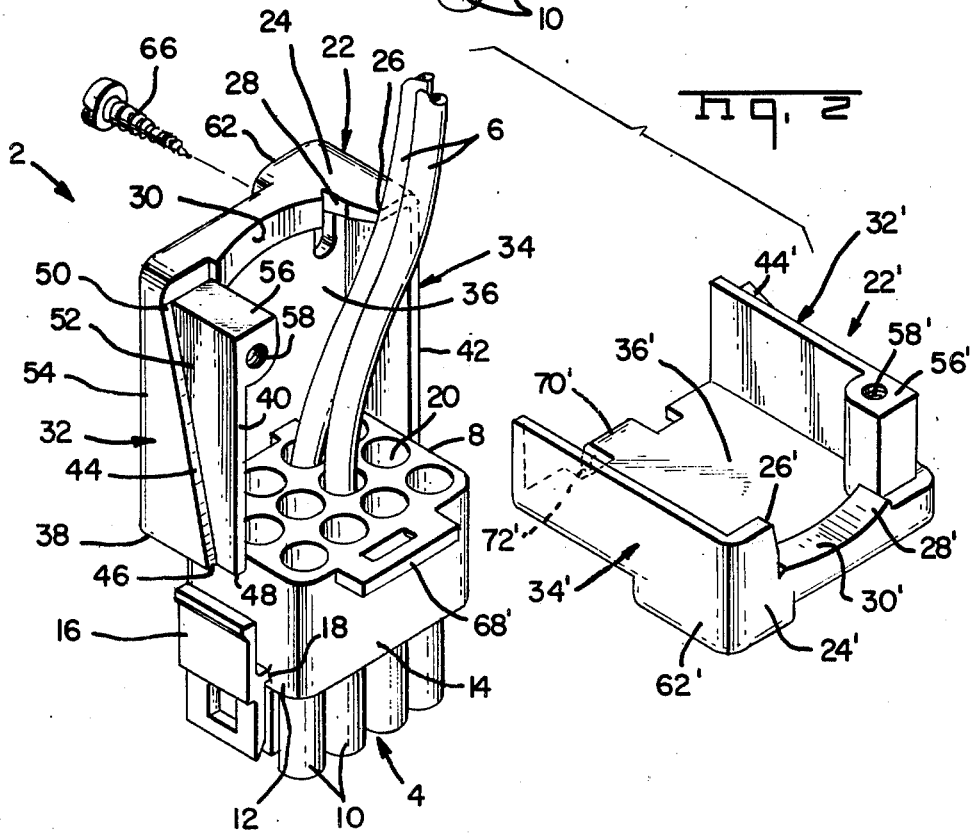
FIG. 2 is a perspective view with one of the back cover parts exploded from the connector housing.

As is apparent from FIG. 1 the wires 6 extend through the rearward end of the enclosure formed by the rearward ends 24, 24', a recess 28 being provided in the back walls of each of the parts 22, 22' to form an opening for these conductors. These recessed 28, 28' have inclined surfaces which extend from the edge 26 and have arcuate surfaces 30 at their inner ends as shown in FIG. 2.

When the two parts are assembled to the housing as shown in FIG. 1, they must be secured to each other and this is accomplished by securing means in the form of a gusset section 56 located at the junction of the sidewall 32 and the rearward end 24. An opening 58 extends into this gusset which receives a screw 66. An oval shaped opening 60 is provided in the third sidewall adjacent to the corner defined by the rearward end and the third sidewall and a boss 62 surrounds this opening on the external surface of the third sidewall. A recessed shoulder 64 is provided in the boss to facilitate seating of the screw in the opening. It will be apparent that when the two parts 22, 22' are against each other in opposed relationship, screws can be inserted through the openings 60 and 60' and threaded into the openings 58 and 58'.

The parts 22, 22' are pivotally mounted on the connector housing by means of L-shaped ears 70, 70' which extend from the third sidewalls 36, 36' and which are received in the openings of staple-like projections on the sidewalls 14 of the housing. It will be apparent that when the end portion 72 of the ear 70 is inserted through the opening, the entire part 2 can be moved arcuately towards the conductors which extend from the housing.

Figure 6:
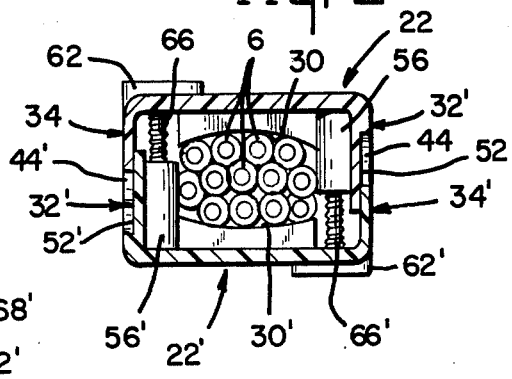
FIG. 6 is a view taken along the line 6—6 of FIG. 1.

In use, the two parts 22, 22' are mounted on the housing by inserting the ends of the ears 70 through the openings in the staple-like projection 68 and moving the parts arcuately towards each other until the internal surface of the sidewalls 34, 34' are against the recessed surfaces 52, 52' of the first sidewalls 32, 32'. The screws are then threaded through the oval-shaped openings and into the openings 58', 58 until the conductors are tightly clamped between the surfaces 30, 30' and the parts are against each other as shown in FIG. 6.

Figure 5:
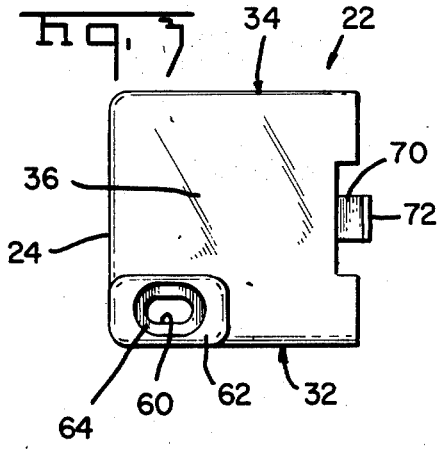
FIG. 5 is a perspective view of a back cover assembled to a connector in which the wires are of a relatively fine gage.
Figure 4:
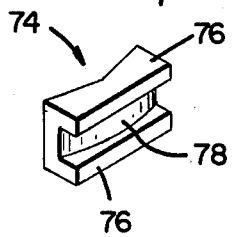
FIG. 4 is a perspective view of an adaptor which is used when the wires extending from the connector are of relatively small diameter.
Figure 7:
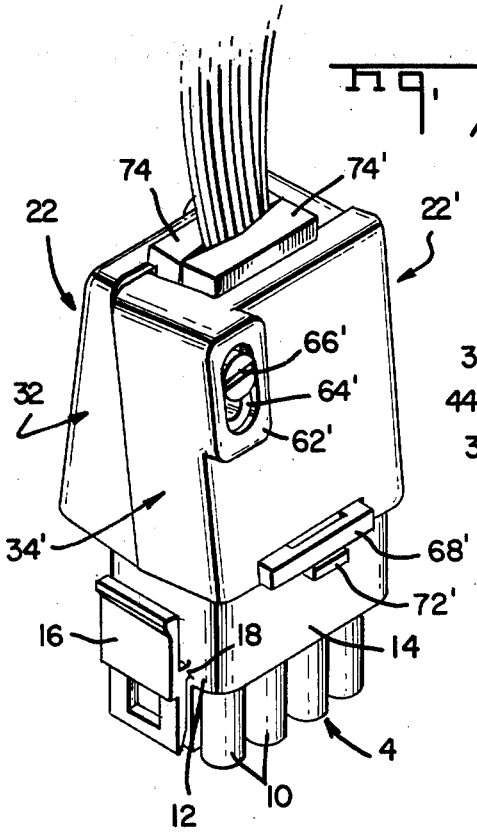

FIG. 1 shows a back cover assembly on a connector having relatively large diameter wires extending therefrom and it will be noted that portions of the recessed surfaces 52 are exposed when the two parts are secured to each other. FIG. 5 shows the parts assembled to a connector having extremely fine diameter conductors extending therefrom and in this instance, the edges 42, 42' are against the shoulders 44', 44 respectively. The smaller diameters of the wires can be clamped tightly by virtue of the fact that the two parts have been moved as close to each other as possible. The wires are gripped between the surfaces 30, 30' with the aid of an adaptor 74 (FIG. 4) which is generally U-shaped but which has an arcuate surface 78 between the legs 76 thereof. One of these adaptors is positioned on each of the surfaces 30, 30' so that the size of the opening formed between the back walls 24, 24' is thereby substantially reduced.

I claim:

1. A hermaphroditic part which, with an identical part, is intended to be mounted on an electrical connector to form a back cover and strain relief for said connector, said hermaphroditic part being of a molded insulating material and comprising a rearward end and first, second, and third sidewalls extending from said rearward end to a forward end, said first and second sidewalls being parallel to each other, said third sidewall extending normally of said first and second sidewalls, said hermaphroditic part being open at said forward end and being open on the side which is opposite to said third sidewall, said first and second sidewalls having free edges which are remote from said third sidewall, a shoulder on the external surface of said first sidewall extending from said forward end towards said rearward end, said first sidewall having a recessed external surface between said shoulder and said free edge, of said first sidewall, mounting means for mounting said hermaphroditic part on a connector housing with said forward open end in partially surrounding relationship to said housing, and means for securing said heraphroditic part to an identical part which is in opposed relationship to said part whereby, upon mounting said hermaphroditic part and an identical part on the rearward face of a connector housing with the conductors of said housing extending between the rearward ends of said parts, the internal surfaces of said second sidewalls of each of said parts will be against said recessed surfaces of the other one of said parts and said conductors will be clamped between the edges of said rearward ends of said parts.

2. A hermaphroditic part as set forth in claim 1, said rearward end having a central recess extending inward from the free edge thereof, said recess and the recess of an identical part forming a confined opening for said conductors when said parts are assembled to said housing.

3. A hermaphroditic part as set forth in claim 1 or 2, said means for securing said part to an identical part comprising fastener receiving openings in said third sidewall.

4. A hermaphroditic part as set forth in claim 1, said mounting means comprising ear means extending from said part at said forward end, said ear means being cooperable with ear-receiving means as a connector housing.

5. A hermaphroditic part as set forth in claim 4, said ear means extending from said third sidewall and being capable of forming a pivotal mounting of said part on said connector housing whereby said part and said identical part can be moved pivotally towards each other on said housing until conductors extending from said housing are tightly gripped between said edges of said rearward end.

6. A hermaphroditic part which, with an identical part, is intended to be mounted on an electrical connector to form a back cover and strain relief for said connector, said hermaphroditic part being of a molded insulating material and comprising a rearward end and first, second, and third coextensive sidewalls extending from said rearward end to a forward end, said first and second sidewalls being parallel to each other, said third sidewall extending normally of said first and second sidewalls, said hermaphroditic part being open at said forward end and being open on the side which is opposite to said third sidewall, a shoulder on the external surface of said first sidewall extending from said forward end to said rearward end, said shoulder originating at a location adjacent to, but spaced from, the outer free edge of said first sidewall at said forward end and extending obliquely towards the plane of said third sidewall, said first sidewall having a recessed external surface between said shoulder and said free edge and having an outer surface between said shoulder and said third sidewall, mounting means for mounting said hermaphroditic part on a connector housing with said forward open end in partially surrounding relationship to said housing, and means for securing said hermaphroditic part to an identical part which is in opposed relationship to said part whereby, upon mounting said hermaphroditic part and an identical part on the rearward face of a connector housing with the conductors of said housing extending between the rearward ends of said parts, the internal surfaces of said second sidewalls of each of said parts will be against said recessed surfaces of the other one of said parts and said conductors will be clamped between the edges of said rearward ends of said parts.

7. A hermaphroditic part as set forth in claim 6, said rearward end having a central recess extending inward from the free edge thereof, said recess and the recess of an identical part forming a confined opening for said conductors when said parts are assembled to said housing.

8. A hermaphroditic part as set forth in claim 6 or 7, said means for securing said part to an identical part fastener receiving openings in said third sidewall.

9. A hermaphroditic part as set forth in claim 6, said mounting means comprising ear means extending from said part at said forward end, said ear means being cooperable with ear-receiving means as a connector housing.

10. A hermaphroditic part as set forth in claim 9, said ear means extending from said third sidewall and being capable of forming a pivotal mounting of said part on said connector housing whereby said part and said identical part can be moved pivotally towards each other on said housing until conductors extending from said housing are tightly gripped between said edges of said rearward end.

* * * * *